US011547230B2

(12) United States Patent
Hsu Besner et al.

(10) Patent No.: US 11,547,230 B2
(45) Date of Patent: Jan. 10, 2023

(54) CUP HOLDER

(71) Applicant: Sunflow, Inc., Short Hills, NJ (US)

(72) Inventors: Leslie Hsu Besner, Short Hills, NJ (US); Jeffrey Servaites, Oakland, CA (US)

(73) Assignee: Sunflow, Inc., Short Hills, NJ (US)

( * ) Notice: Subject to any disclaimer, the term of this patent is extended or adjusted under 35 U.S.C. 154(b) by 26 days.

(21) Appl. No.: 17/147,938

(22) Filed: Jan. 13, 2021

(65) Prior Publication Data

US 2021/0361101 A1 Nov. 25, 2021

Related U.S. Application Data

(60) Provisional application No. 63/028,487, filed on May 21, 2020.

(51) Int. Cl.
*A47G 23/02* (2006.01)

(52) U.S. Cl.
CPC .... *A47G 23/0225* (2013.01); *A47G 2400/086* (2013.01)

(58) Field of Classification Search
CPC ..... A47G 23/0225; A47G 2400/086; A47G 23/0216; A47G 23/02; A47G 23/0208
See application file for complete search history.

(56) References Cited

U.S. PATENT DOCUMENTS 2,754,078 A * 7/1956 Koger ..... B60N 3/102 248/291.1
3,233,858 A * 2/1966 Benjamin ..... B60N 3/102 248/311.2
4,191,350 A 3/1980 Ormond
4,828,211 A * 5/1989 McConnell ..... B60N 3/102 248/316.4

(Continued)

FOREIGN PATENT DOCUMENTS

CN 105137502 A 12/2015
IT P120 110 039 A1 10/2012

(Continued)

OTHER PUBLICATIONS

Extended European Search Report for European Application No. 21158654.0, dated Aug. 23, 2021.

*Primary Examiner* — Devin K Barnett
(74) *Attorney, Agent, or Firm* — Wolf, Greenfield & Sacks, P.C.

(57) ABSTRACT

Disclosed herein is an adjustable cup holder for holding a beverage container. The adjustable cup holder includes a body, a base configured to support the weight of a beverage container, an adjustable diameter ratchet strap configured to accommodate a diameter of the beverage container, and a connector. The holding portion of the cup holder may be connected to the body via a first hinge configured such that the beverage container holding portion is rotatable relative to the body about an axis to allow beverage container (Continued)

holding portion to hold the beverage container relatively level. The holding portion of the cup holder may be connected to the body via a hinge configured such that the beverage container holding portion is pivotable relative to the body about an axis from a use position to a stowed position.

8 Claims, 6 Drawing Sheets

(56) References Cited

U.S. PATENT DOCUMENTS 4,887,784 A * 12/1989 Kayali ..... F16M 13/022 248/231.51
4,984,722 A * 1/1991 Moore ..... B60N 3/102 224/558
5,014,956 A * 5/1991 Kayali ..... B60N 3/106 248/311.2
5,072,909 A * 12/1991 Huang ..... B60N 3/102 248/316.4
5,318,266 A * 6/1994 Liu ..... B60N 3/106 248/292.12
5,342,009 A * 8/1994 Lehner ..... A47G 23/0225 248/311.2
D355,337 S * 2/1995 Eisenbraun ..... D7/620
5,505,417 A * 4/1996 Plocher ..... B60N 3/102 248/311.2
5,603,477 A * 2/1997 Deutsch ..... B60N 3/106 248/292.12
6,047,937 A * 4/2000 Huang ..... B60N 3/102 248/312.1
6,095,471 A * 8/2000 Huang ..... B60N 3/102 224/400
6,527,240 B1 * 3/2003 Huang ..... A47G 23/0225 248/231.41
7,959,121 B1 * 6/2011 Barnes, Jr. ..... A47G 23/0225 248/311.2
8,851,436 B2 * 10/2014 Adachi ..... A47G 23/0216 248/312.1
9,241,554 B1 * 1/2016 Tong ..... A45C 13/00
9,295,320 B1 * 3/2016 McManus ..... A45F 5/021
9,668,611 B2 * 6/2017 Zhitnitsky ..... A47J 36/34
9,944,209 B1 4/2018 Carnevali
9,945,514 B1 * 4/2018 Huang ..... F16M 13/022
10,531,755 B1 * 1/2020 Huang ..... F16B 2/12
10,631,651 B1 * 4/2020 Hsu Besner ..... A47C 7/407
10,932,601 B1 * 3/2021 Fan ..... F16M 13/02
2002/0070324 A1 * 6/2002 Huang ..... A47G 23/0225 248/230.1
2003/0015638 A1 * 1/2003 Yamada ..... B60N 3/102 248/685
2007/0090136 A1 * 4/2007 Stowell ..... A44B 11/005 224/163
2013/0075562 A1 * 3/2013 Miklas ..... B60N 3/102 248/286.1
2015/0069075 A1 * 3/2015 Robbins, III ..... A47G 23/0216 220/737
2015/0164256 A1 * 6/2015 Helton ..... A47G 23/0216 220/738
2017/0325559 A1 * 11/2017 Johnson ..... A47G 23/0216
2018/0134493 A1 * 5/2018 Cunningham ..... A47G 23/0216
2018/0147968 A1 * 5/2018 Ghannam ..... A47G 23/0216
2018/0338623 A1 * 11/2018 Winterhalter ..... A47C 4/20
2020/0002006 A1 * 1/2020 Slack, Jr. ..... A47C 7/622
2021/0106491 A1 * 4/2021 Johnson ..... A61H 1/00
2022/0023135 A1 * 1/2022 Johnson ..... A47G 23/0225

FOREIGN PATENT DOCUMENTS

TW M492257 U 12/2014
TW M511264 U 11/2015
TW I626913 B 6/2018
TW 201832702 A 9/2018

* cited by examiner

CUP HOLDER

RELATED APPLICATIONS

This application claims the benefit under 35 U.S.C. § 119(e) to U.S. Provisional Application Ser. No. 63/028,487, entitled "Cup Holder", filed on May 21, 2020, which is herein incorporated by reference in its entirety. This application also incorporates by reference U.S. Pat. No. 10,631,651 in its entirety.

FIELD

Disclosed embodiments relate generally to cup holders, specifically to cup holders configured to adjust to differently sized beverage containers.

BACKGROUND

Cup holders secure cups, glasses, cans, bottles, or other beverage containers configured to hold fluids and/or other substances. Cup holders may be integrally formed in cars, boats, furniture, or other products in which it may be desirable to stow a cup such that it is easily accessible and spilling is avoided.

SUMMARY

According to one aspect, an adjustable cup holder is provided. The cup holder includes a body, a base coupled to the body, and an adjustable diameter ratchet strap coupled to the body. The base is constructed and arranged to support the weight of a beverage container. The adjustable diameter ratchet strap is configured to accommodate the diameter of a beverage container to limit the beverage container from tipping relative to the body.

According to another aspect, an adjustable cup holder is provided. The cup holder includes a body and a beverage container holding portion. The beverage container holding portion is connected to the body via a first hinge that is configured such that the beverage container holding portion is rotatable relative to the body about a first axis to allow beverage container holding portion to hold the beverage container relatively level.

According to another aspect, an adjustable cup holder is provided. The cup holder includes a body and a beverage container holding portion. The beverage container holding portion is connected to the body via a hinge that is configured such that the beverage container holding portion is pivotable relative to the body about an axis from a use position to a stowed position.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
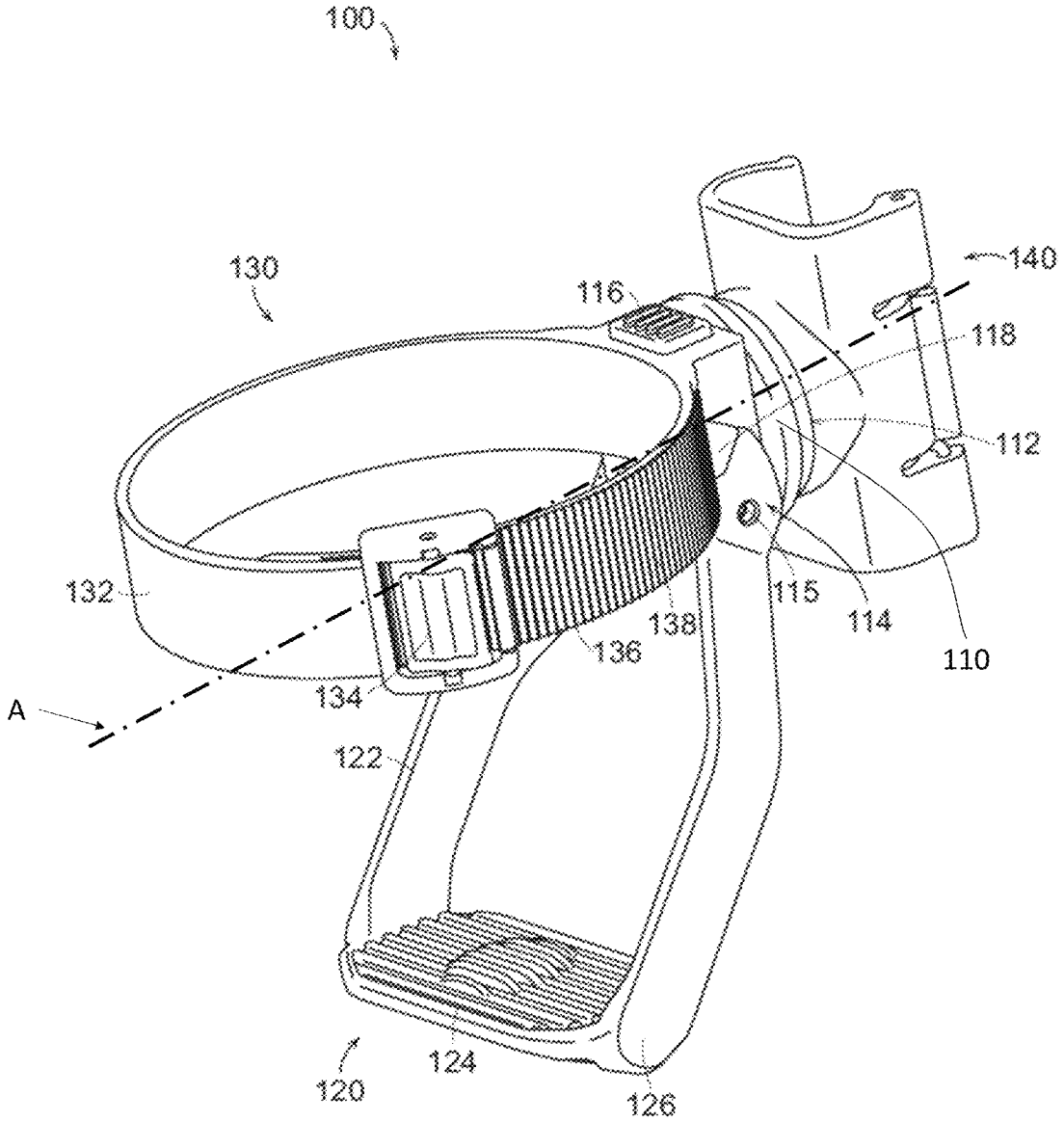
FIG. 1 is a front, top, right side perspective view of an embodiment of an adjustable cup holder in a use position.

Cup holders (also referred to herein as a beverage container holder) are configured to hold a cup or other beverage container such that it is secure and easily accessible. Some cup holders are integrally formed with the product with which they are associated with. For example, the cup holders in automobiles may be integrally formed into a console of the car. Other existing cup holders require mounting hardware, and occasionally modifications to the product to which they are being mounted. For example, bicycle cup holders, often referred to as cages, are typically mounted to bikes with threaded fasteners. This requires tools, and makes transferring a cage from one bike to another cumbersome. Many bikes are pre-configured with threaded holes for cages, requiring users to tap their own holes.

Beyond being difficult to install, existing cup holders offer limited adjustability to improve ease of access, ergonomics, and/or cup orientation. Traditional cup holders additionally are not typically configured to hold and secure cups with varied dimensions. For example, cup holders configured with a fixed diameter may not sufficiently hold either narrow cups, for example, slim energy drink cans, or wide cups, for example insulated water bottles.

Appreciating these deficiencies, the inventors recognize the value of an adjustable cup holder. Such a cup holder may comprise a body and a base coupled thereto that is configured to support the weight of a cup. The body of the cup holder may additionally include an adjustable diameter ratchet strap configured to accommodate a cup held by the cup holder. The diameter of the ratchet strap may be adjustable such that it may accommodate cups of various sizes. For example, the diameter of the ratchet strap may be increased to accommodate relatively large diameter containers and decreased to accommodate relatively smaller diameter containers. The adjustable diameter ratchet strap may be configured to prevent such containers from tipping and/or moving laterally when accommodated by the adjustable diameter ratchet strap. In certain embodiments, the base of the cup holder may include a platform supported by one or more arms connected to the body. The platform may include an upper surface configured to span at least a portion of the bottom of a cup such that when a cup is installed in the cup holder, the cup rests on the upper surface of the platform.

In certain embodiments, the cup holder may additionally comprise a first hinge. The first hinge may be configured such the base and the adjustable diameter ratchet strap may be rotated relative to the body of the cup holder. The first hinge may enable a cup supported by the base and accommodated by the adjustable diameter strap to be held level with the ground regardless of the orientation of the body. In this respect, the liquid in the container is therefore relatively level with the ground. In some instances, this may reduce the likelihood that the cup will tip, spill, or generally be held in an unstable orientation. It may be desirable that the first hinge include sufficiently robust detents or locks such that a container held by the holder does not unintentionally rotate relative to the body about the first hinge.

In further embodiments, the base and adjustable diameter ratchet strap is connected to the body by a second hinge such that the base and the adjustable diameter ratchet strap may fold relative to the body of the cup holder. In such embodiments, the base and the ratchet strap may be configured to fold from a use/extended position to a folded position. The holder may be configured to hold the container when in the use position. The cup holder may be configured to transition to the folded position, which may be relatively more compact than the use position, for storage purposes when the holder is not holding a container. It may be additionally be desirable for the cup holder to comprise a lock to keep the cup holder in either the use position or the folded position. Such a lock may engage automatically when the cup holder is fully transitioned to one position, and may disengage upon the actuation of a button by a user.

In certain embodiments, the cup holder includes a connector configured to removably connect the cup holder to a structure. In some embodiments, the structure may be part of a chair, a stroller, or a piece of furniture. The connector may be configured specifically to match the structure to which it attached. In some embodiments, the connector may comprise additional wires, straps, belts, or other components such that it can be securely fastened to the structure.

As described above, a base may be coupled to the body of a cup holder. The base may comprise one or more rigid, elongated arms. For example, the base may comprise two arms. Each arm may comprise a proximal end located close to the body of the cup holder. The proximal end of each arm may include one or more features configured to couple the arm to the base. The connection features may additional be configured to enable each arm to pivot relative to the base. For example, the proximal end of each arm may comprise a cylindrical channel through which an axle operatively coupled to the base may be routed. In some embodiments, the one or more arms may be straight. In other embodiments, one or more of the arms may include at least one bend or curve along its length. A bend or curve may be included to prevent the arms from interfering with a cup as it is inserted into or held by the cup holder. This may be especially desirable in cup holders configured to hold relatively wide cups. In some embodiments, the arms of the base may additionally be configured to prevent the cup from moving laterally over the base. For example, the arms may comprise one or more features to grip a cup held by the cup holder. In some embodiments, the arms may be configured such that the length of the arms may be increased or decreased. For example, the arms may be configured with telescopic functionality. Such a configuration may be desirable when the cup holder is configured to hold cups of various heights. Such a configuration may also be desirable such that the cup holder is collapsible for storage or transportation purposes. Each arm may additionally comprise a distal end opposite the proximal end. A platform may be coupled to the distal end of each arm. In some embodiments the platform may be pivotably coupled to the distal ends of each arm such that an upper surface of the platform may be oriented level with the ground regardless of the angle of the arms relative to the ground. The platform may include one or more ribs or other features for structural and/or aesthetic purposes. In embodiments where in the platform comprises ribs, the ribs may vary in height along their lengths. For example, in certain embodiments, an upper surface of the platform may comprise a series of parallel ribs running along a longitudinal axis of the platform. The ribs may increase in height at a generally central portion of the platform. Such a configuration may be desirable in instances where the cup holder is used to hold a cup with a concave bottom surface, such as a standard beverage can. The platform may also contain drainage features, such as one or more suitably sized holes or channels, such that fluid may drains through the platform instead of collecting on the platform. In some embodiments, the arms and/or platform may be rigid, and may, for example, comprise a plastic (e.g., PP, PET, ABS, Nylon, etc.) or a metal (e.g., aluminum, stainless steel, titanium, etc.). In alternate embodiments, the arms and/or platform may be configured to be flexible, and may, for example, comprise a fabric or elastic material.

In some embodiments, an adjustable diameter strap may be coupled to the body of the cup holder. The adjustable diameter strap includes two flexible members. A proximal end of each member may be coupled to the body of the cup holder. A distal end of the first member includes a ratcheting buckle. At least a portion of the exterior surface of the second member may be configured as a ladder strap. The two members may be configured and arranged such that when the second member comprising the ladder strap is inserted into the ratchet buckle of the first member, a substantially circular arrangement is formed. The circular arrangement may be configured to accommodate the outer diameter of a cup supported by the base and held by the cup holder. The ratchet strap may be configured such that tightening the ratcheting buckle pulls the ladder strap through the ratcheting buckle decreasing the diameter of the ratchet strap. Thus, tightening the ratchet strap may be done to accommodate a cup with a relatively small diameter. The ratchet strap may additionally be configured such that loosening the ratcheting buckle pushes the ladder strap out through the ratcheting buckle increasing the diameter of the ratchet strap. Thus, loosening the ratchet strap may be done to accommodate a cup with a relatively wide diameter. The adjustable diameter ratchet strap may be configured to hold cups comprising a wide range of diameters. For example, the ratchet strap may be configured to accommodate cups with a diameter between 2 and 4 inches, or 2 and 5 inches, or 1.5 and 6 inches. In some embodiments, the cup holder may be configured to cups smaller or larger diameters than these listed. Generally, the adjustable diameter ratchet strap is configured to be tightened or loosed to accommodate a cup such that the cup may be easily removed from and inserted into the cup holder, while being securely held such that the cup does not translate laterally or tilt. In some instances, it may be desirable to tighten the ratchet strap such that it tightly grips the beverage container. For example, in embodiments where the cup holder is configured to be connected to the beach chair disclosed in U.S. Pat. No. 10,631,651, a user may wish to tighten the adjustable diameter ratchet strap such that it tightly grips a beverage container in order to prevent the beverage container from falling out of the cup holder when the chair is moved.

In some embodiments, an interior surface of the adjustable diameter ratchet strap may comprise a relatively high friction material configured to grip the outer diameter of the cup. For example, the inner surface of the ratchet strap may comprise one or more pieces of silicone or another rubber material configured to grip the exterior surface of the cup. In some embodiments, the ratchet strap may comprise one or more materials with relatively low thermal conductivities configured to insulate the cup. For example, the ratchet strap may comprise Styrofoam configured to insulate the cup. Alternate embodiments may comprise an electrically powered heater or cooler (e.g., resistance, Peltier, etc.) to aid with maintaining the contents of the container at about the desired temperature.

In some embodiments the cup holder may be configured such that the diameter of the ratchet strap is adjustable by means other than a ratchet strap. For example, some embodiments may comprise an elastic material configured to stretch to accommodate cups with a relatively large diameter and contract to accommodate cups with a relatively small diameter. Other embodiments may comprise a hook and loop fastener, belt buckle, BOA system, or other means of adjusting the strap diameter. In some embodiments, the strap may not be configured to be adjustable.

In some embodiments, the cup holder may additionally comprise a connector configured to removably connect the cup holder to a structure. The structure may be a part of a chair, a stroller, a piece of furniture, or any other suitable product as the disclosure is not limited in this respect. In some embodiments, the connector maybe a universal connector configured to connect the cup holder to a variety of structures. In any case, the structure may comprise a distinctly cross-sectional shape, and, the connector may comprise two or more arms configured to define a cavity with a similar cross-sectional shape. For example, in certain embodiments, the structure may comprise a stadium shaped cross-section. In such embodiments, the connector may comprise two or more arms configured to define a stadium shaped cavity. The cavity defined by the two or more arms may include one or more openings such that it can be installed on the structure. In such an embodiment, the connector and/or the arms of the connector may be configured to be sufficiently resilient such that the connector can deform around the structure as it is pushed onto the structure before returning to its unstressed shape and grips the structure. For example, the connector may comprise a plastic material or a composite material with resilient properties. For example, an embodiment of the cup holder described herein is configured to mount to a leg of the chair disclosed in U.S. Pat. No. 10,631,651, which is assigned to the assignee of this application, and which, as noted above, is herein incorporated by reference in its entirety. The connector may additionally include features such as ribs or slots to increase its resiliency. In some embodiments, the connector may additionally comprise a rigid or elastic strap, buckle, or latching mechanism configured lock the connector to the structure. In some embodiments, an interior surface of the connector may comprise a relatively high friction material, such as silicone, configured to grip the structure, preventing the connector from slipping.

As described above, a cup holder may comprise a body, to which a base, an adjustable diameter ratchet strap, and a connector are be coupled. The body may additionally comprise a first hinge, which may enable a cup supported by the base and accommodated by the adjustable diameter ratchet strap to be oriented level relative to the ground regardless of an orientation of the body and/or the connector. Such a hinge may enable 360 degree rotation about its axis in either a clockwise or counterclockwise direction. In alternate embodiments, the hinge may be configured such that it only permits a limited range of rotation, for example, rotation up to 90, 180, or 270 degrees in either a clockwise or a counterclockwise direction. In some embodiments, rotation may only be limited to a single direction, for example, a clockwise direction. In some embodiments, the hinge may comprise one or more detents configured such that a plurality of discrete orientations exist wherein the base and adjustable diameter ratchet strap are held in a sufficiently locked orientation relative to the body and/or connector. These detents may be robust in that that they are able to hold the weight of a cup and its contents at a desired orientation against one or more forces (e.g., gravity, acceleration of a structure to which the cup holder is attached, impact, etc.). In some embodiments, it may be desirable to include a lock to selectively lock the location of the base and adjustable diameter strap relative to the body and/or connector. In some embodiments, the first hinge may comprise a hirth coupling, although it should be appreciated that any type of hinge enabling rotation may be used as the disclosure is not limited in this respect.

In certain embodiments, the cup holder may additionally comprise a second hinge configured such that the base and the adjustable diameter strap may transition from a use position, in which the cup holder is configured to hold a cup, to a folded position, in which the cup holder takes on a relatively more compact configuration. A folded position may be desirable for storage purposes when the cup holder is not being used to hold a cup. In some embodiments, the second hinge may comprise an axle or pin. The axle may extend through a suitably sized cylindrical channel in the body of the cup holder that extends through the body from a first side of the body to a second side of the body. The axle may be configured to extend past the outer surface of the body on both the first side and the second side. In such embodiments, the adjustable diameter ratchet strap may comprise two substantially parallel flanges extending outwardly from the ratchet strap. Each flange may similarly comprise a suitably sized cylindrical channel extending through each flange such that the axle may additionally be routed through the channel located on each flange. In this way, the adjustable diameter ratchet strap may be pivotable relative to the body about the axle. The axle may additionally be configured to extend past the outer surface of each flange of the adjustable diameter ratchet strap. In such embodiments, each arm of the base may also comprise a suitably sized cylindrical channel extending through each arm such that the axle may additionally be routed through the channel located on each arm. This configuration may additionally allow the base to be pivotable relative to the body about the axle. In some embodiments, a c-clip, e-ring, or other means of retaining the axle may arranged to maintain desired placement of the axle. For example, in the embodiment described above, a first c-clip may be coupled to the axle against an outward facing surface of the first arm of the base and a second c-clip may be coupled to the axle against an outward facing surface of the second arm of the base such that the axle is prevented from translating along a longitudinal axis of the axle. In some embodiments, the base may be fixedly coupled to the adjustable diameter ratchet strap such that when the ratchet strap pivots, the base also pivots. In other embodiments, the adjustable diameter ratchet strap may be coupled to the base such that when the base pivots, the ratchet strap also pivots. In some embodiments, the cup holder may be configured to include multiple independent axles. For example, the base and the adjustable diameter ratchet strap may each be operatively coupled to independent axles. In further embodiments, the second hinge may be configured as a different variety of hinge that does not utilize an axle, such as a living hinge. In further embodiments still, one of the base or the adjustable diameter ratchet strap may be fixedly coupled to the body and/or connector such that the base or the ratchet strap cannot pivot relative to the body and/or connector. For example, the base may be configured to pivot on an axle as described above, wherein the adjustable diameter ratchet strap may be fixedly coupled and/or unitary with the body such that it is not pivotable relative to the body.

In certain embodiments, the cup holder may comprise one or more features configured to stop rotation of one or both of the base or the adjustable diameter strap upon reaching a desired position. For example, in certain embodiments, extrusions may protrude from an outer surface of the cup holder that are configured to prevent the base or the adjustable diameter sleeve from rotating past a desired position. Such rotation stops may be configured to ensure a specific relative alignment of components. For example, an embodiment may be configured with extrusions that protrude from an outer surface of the body and stop the base from rotating at a position that ensures at least a portion of the base remain underneath the adjustable diameter ratchet strap. This configuration may ensure that the bottom of a cup accommodated by the adjustable diameter ratchet strap is over at least a portion of the base when the cup holder is in the use position.

In certain embodiments, the second hinge may additionally comprise one or more locks configured to selectively retain the cup holder in either the extended or the folded state. For example, the adjustable diameter ratchet strap may comprise a feature configured to slot into a cavity formed in the body of the cup holder as the ratchet strap pivots to the use position about the second hinge. The body may comprise one or more actuated components configured to selectively retain the feature of the ratchet strap upon entry, preventing the ratchet strap from pivoting out of the use position until the feature is released by a user action. In other embodiments, a magnetic lock, or other suitable variety of lock may be used. Regardless of variety, a lock may be included to prevent the cup holder from transitioning form one of the use position and the folded position to the other of the use position and the folded position. This may be desirable, for example, the ensure that the holder does not transition from the use position to the folded position when a beverage container is placed in the holder, which may result in the beverage being spilled.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

Figure 5:
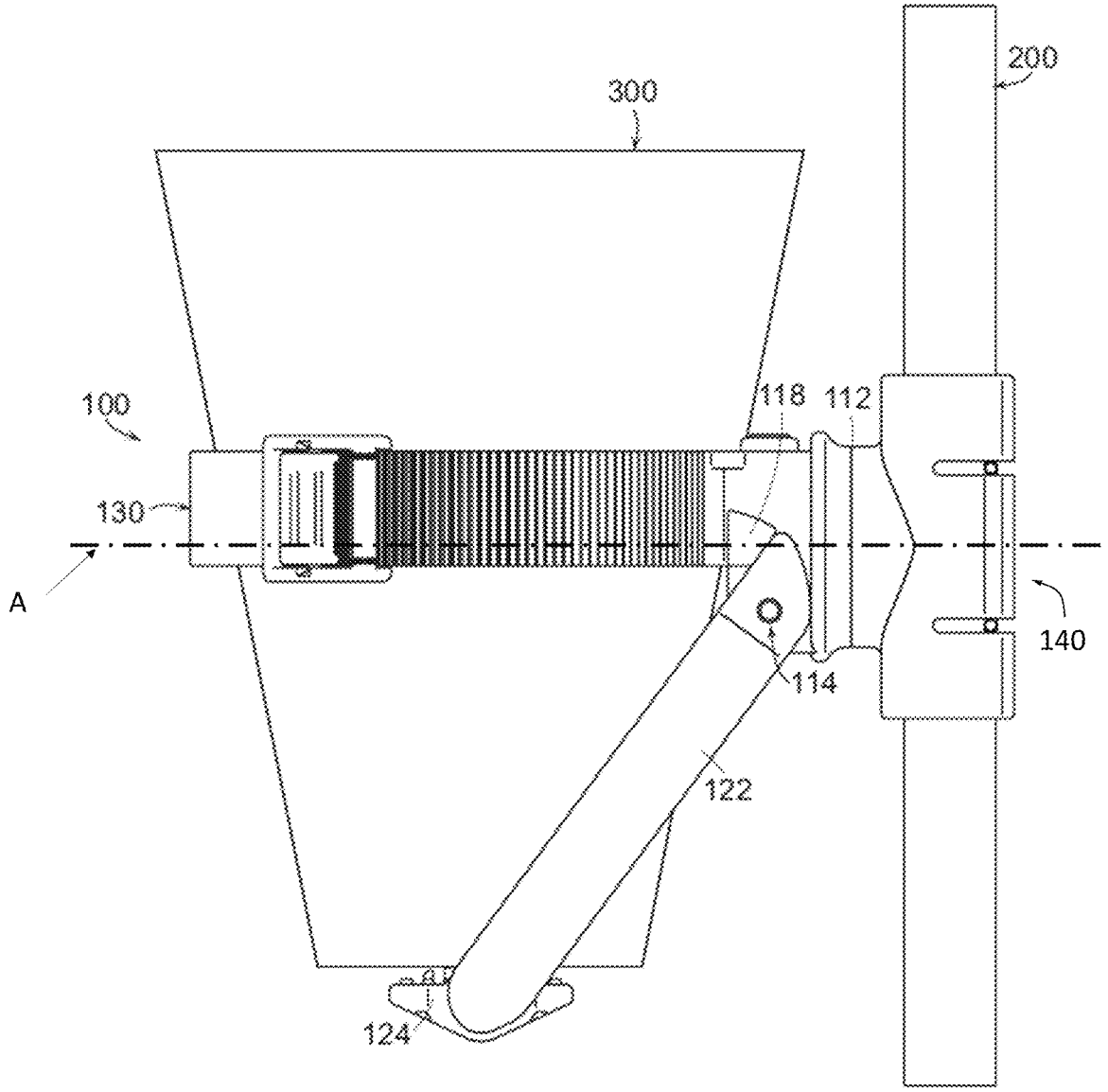
FIG. 5 is a right side elevation view of the adjustable cup holder of FIG. 1 shown holding a beverage container mounted to a structure.

FIGS. 1-6 show an embodiment of an adjustable cup holder 100. Referring initially to FIG. 1, the depicted embodiment comprises a body 110, a base 120, an adjustable diameter ratchet strap 130, and a connector 140. The base 120 comprises two arms 122. The proximal end of each arm 122 is coupled to the body 110 at a second hinge 114. A portion of each arm extends past the pivot point defined by the axle 115 of the second hinge 114. The portion of each arm 122 that extends past the pivot point abuts stop 118, preventing further rotation of each arm 122, when the cup holder 100 has been fully transitioned to the use position shown in FIG. 1. This configuration limits the range across which base 120 can rotate. Each arm 122 comprises a bend along the length of the arm 122 such that neither arm 122 interferes with the insertion of a cup 300 being installed in the cup holder 100 as shown in FIG. 5. Referring to FIG. 1, a platform 124 is pivotably coupled to the distal end of each arm 122. The platform 124 comprises a plurality of parallel ribs on an upper surface of the platform 124. As shown in FIG. 5, when a cup 300 is inserted into the cup holder 100, a bottom surface of the cup 300 rests upon the upper surface of the platform 124 such that the cup holder 100 supports the weight of the cup 300.

The depicted embodiment of an adjustable cup holder 100 additionally comprises an adjustable diameter ratchet strap 130. The ratchet strap comprises a first member 132 and a second member 136. A ratcheting buckle 134 is coupled to the distal end of the first member 132. An exterior surface of the second member 136 is configured as a ladder strap as shown. When the second member 136 is coupled to the first member 132 via the ratcheting buckle 134 as shown in FIGS. 1-6, a substantially circular arrangement results as is shown. When the ratchet strap 130 is tightened, the diameter is reduced. When the ratchet strap 130 is loosened, the diameter is increased. As shown in FIG. 5, when a beverage container 300 is inserted in to the cup holder 100, the ratchet strap 130 accommodates a diameter of the cup 300. This accommodation prevents the cup 300 from moving laterally and/or tipping.

Figure 2:
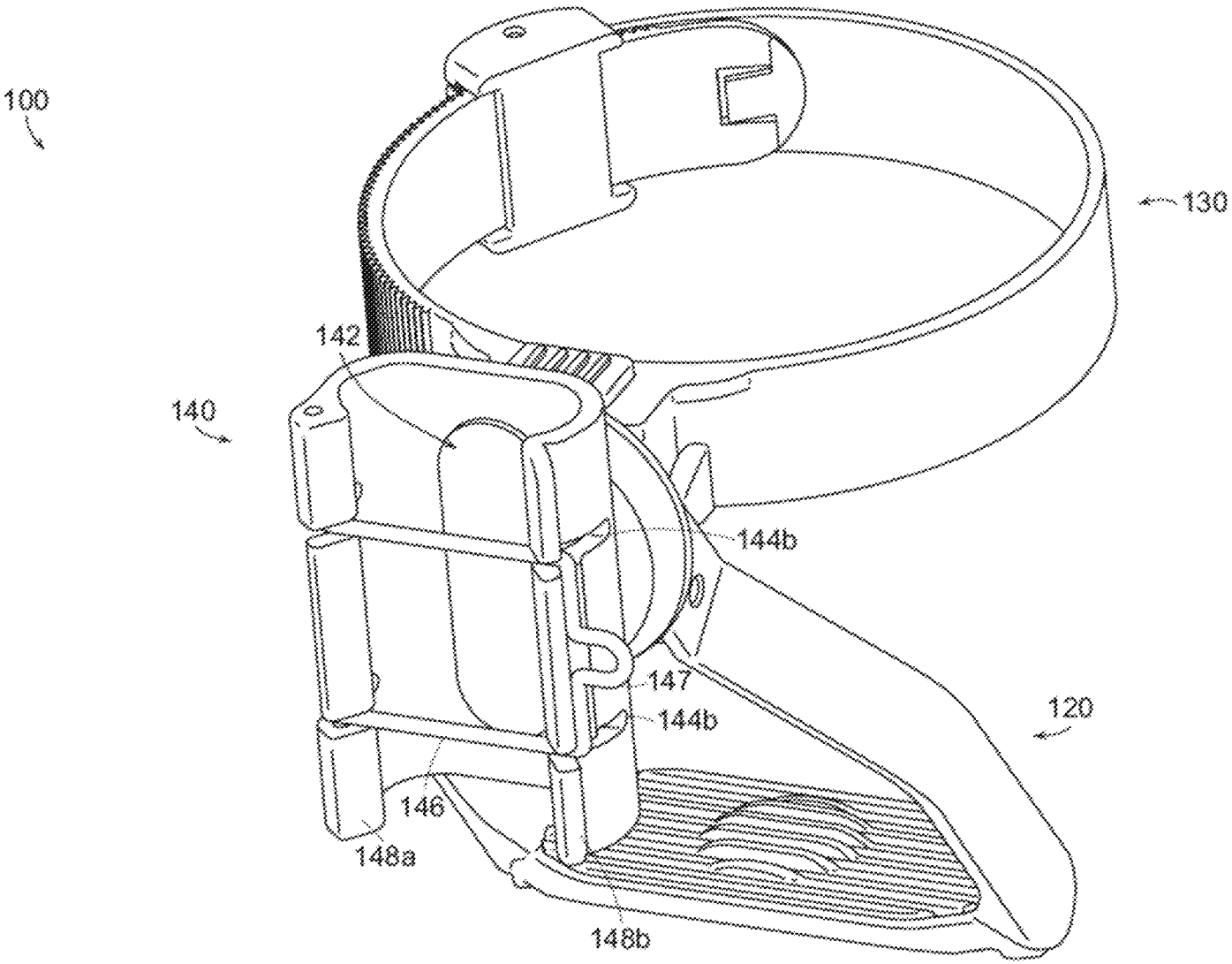
FIG. 2 is a rear, top, left side perspective view of the adjustable cup holder of FIG. 1.
Figure 3:
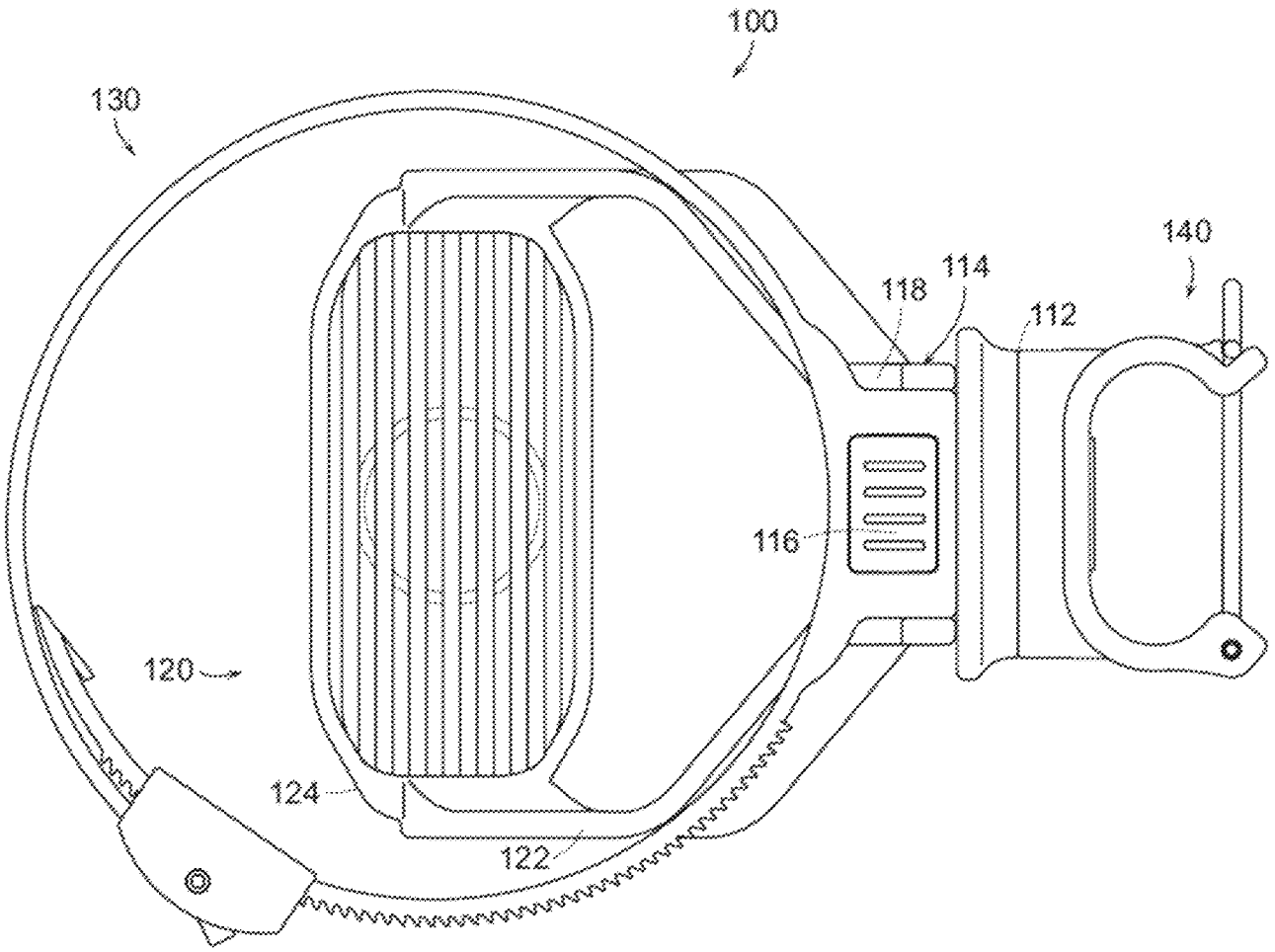
FIG. 3 is a top plan view of the adjustable cup holder of FIG. 1.
Figure 4:
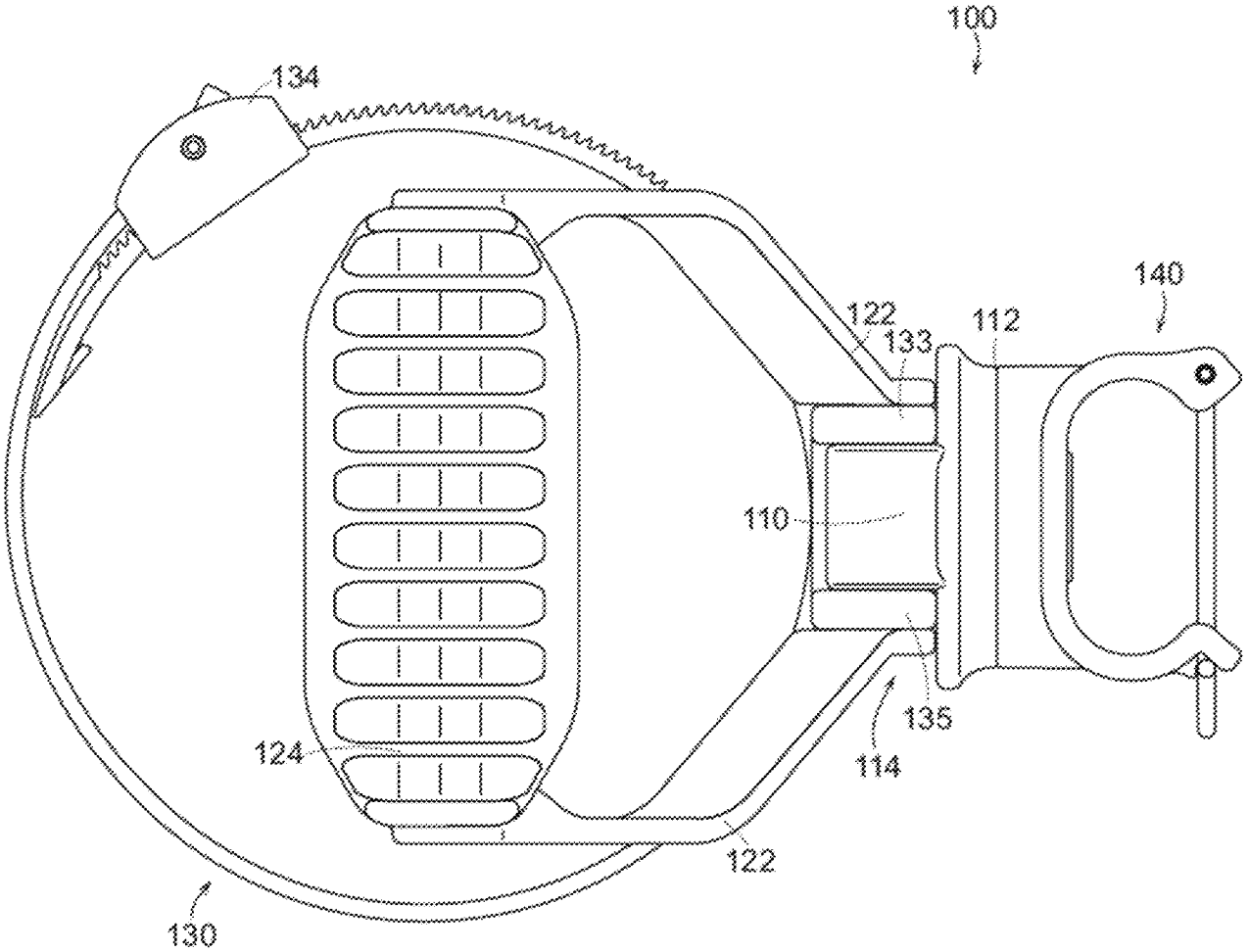
FIG. 4 is a bottom plan view of the adjustable cup holder of FIG. 1.

The depicted embodiment of an adjustable cup holder 100 further comprises a connector 140, best seen in FIG. 2. Connector 140 defines a cavity 142, configured to correspond to the cross-sectional shape of a structure 200 to which connector 140 is connected. In this embodiment, the structure 200 comprises a stadium shaped cross section, thus the connector 140 defines a stadium shaped cavity 142. As depicted, opposing hemispheres 148*a* and 148*b* are formed by two arms of the connector 140. Each hemisphere 148*a* and 148*b* comprises a material with resilient properties as described above. Thus, the opposing hemispheres 148*a* and 148*b* may be deformed in an outward direction such that the connector 140 may accommodate the structure 200 before returning to their original shape such that the connector 140 grips the structure 200. Additionally, connector 140 includes wire strap 146 with handle 147 that connects opposing hemispheres 148*a* and 148*b* as shown in FIG. 2 and locks the connector 140 to the structure 200.

The body 110 of the adjustable cup holder depicted in FIGS. 1-6 additionally comprises a first hinge 112. As shown, the first hinge 112 is a hirth coupling configured to enable the base 120 and the adjustable diameter ratchet strap 130 to rotate 360 degrees in the clockwise or counterclockwise direction about axis A. Such a configuration enables the platform 124 of the base 120 to remain level with the ground regardless the orientation of the body 110 and/or connector 140, such that a cup 300 supported by the platform 124 would also be level with the ground. For example, if the structure 200 to which the cup holder 100 was connected via connector 140 was angled relative to the ground, first hinge 112 could be rotated to compensate such that a cup 300 held by the cup holder 100 remain level, preventing the cup 300 from tipping, spilling, or being held in an imbalanced and/or undesirable orientation.

Figure 6:
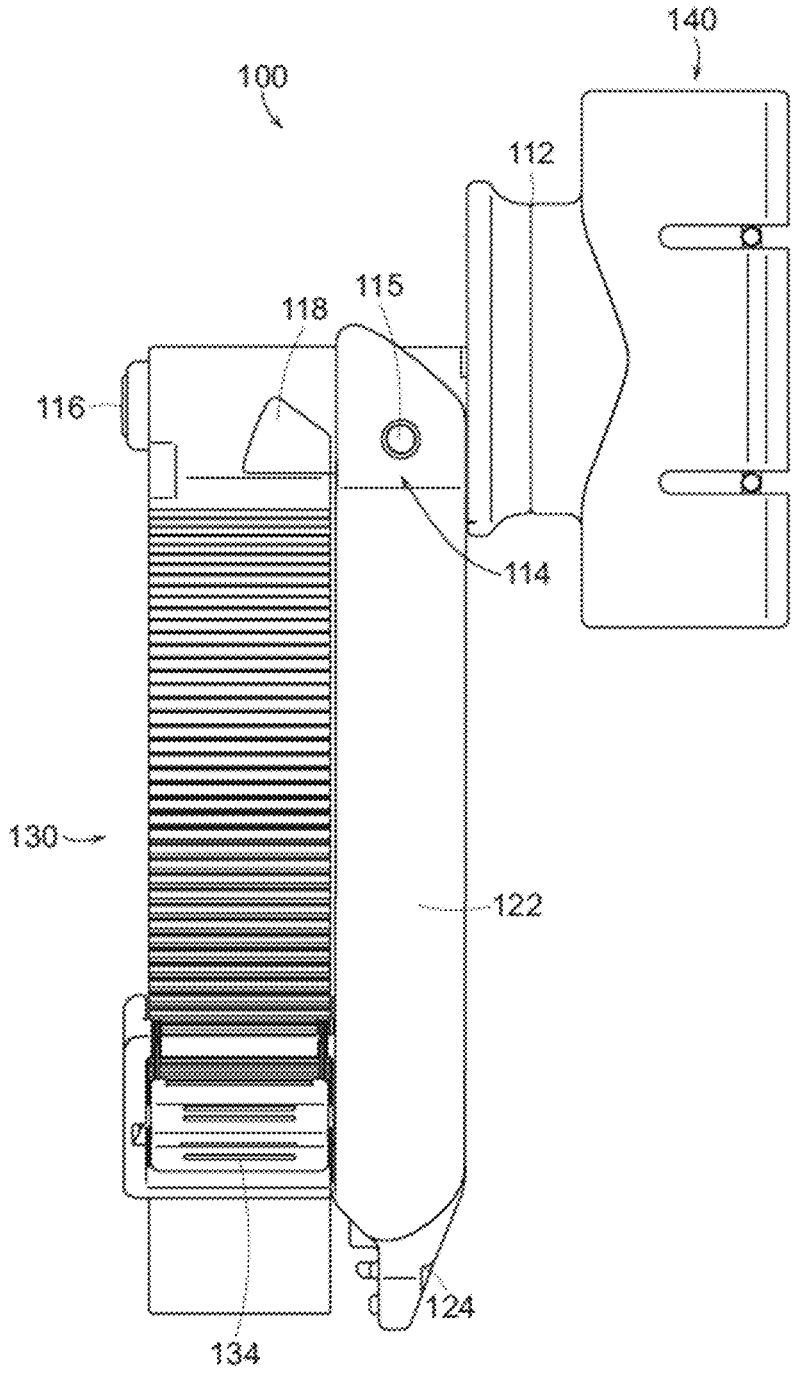
FIG. 6 is a right side elevation view of the adjustable cup holder of FIG. 1 shown in the folded position.

The body 110 of the adjustable cup holder 100 depicted in FIGS. 1-6 additionally comprises a second hinge 114 configured such that the cup holder may transition from an extended state, as shown in FIGS. 1-5, to a folded state, as shown in FIG. 6. In the extended state, the cup holder 100 may be configured to hold a cup 300 as shown in FIG. 5. In the folded state, the cup holder may be configured to assume a more compact arrangement such that it can be stowed more efficiently as shown in FIG. 6. The hinge 114 comprises an axle 115 that extends through a channel formed in the body 110, both arms 122 of the base 120, and the two flanges 133 and 135 of the adjustable diameter ratchet strap 130. This configuration allows the base 120 and the adjustable diameter ratchet strap 130 to independently pivot relative to the body 110 and the connector 140. In the configuration shown, the cup holder 100 is locked when in the extended state. Button 116 is configured to unlock the cup holder 100 when actuated such that the cup holder 100 may be transitioned to the folded state. In the folded state, the arms 122 and platform 124 of base 120 and the adjustable diameter ratchet strap 130 are pivoted such that they are all substantially parallel with each other as shown in FIG. 6.

As shown and described, the adjustable cup holder is configured to hold a cup or similar container, however, it should be appreciated that such an apparatus may be configured or to hold any number of items as the disclosure is not limited in this respect. For example, the cup holder may be used to hold a mobile phone or other electronic device, food container, pet food, pet accessory, children's toy, etc.

Having thus described several aspects of at least one embodiment, it is to be appreciated various alterations, modifications, and improvements will readily occur to those skilled in the art. Such alterations, modifications, and improvements are intended to be part of this disclosure, and are intended to be within the spirit and scope disclosed herein. Accordingly, the foregoing description and drawings are by way of example only.

What is claimed is:

1. An adjustable cup holder comprising:

a body having a first hinge;

a base having arms coupling the base to the body;

a second hinge coupling the base and a beverage container holding portion to the body;

wherein the first hinge is configured such that the beverage container holding portion and the base are rotatable about a first axis to allow the beverage container holding portion and the base to hold the beverage container relatively level;

wherein the second hinge is configured such that the beverage container holding portion and the arms of the base are pivotable about a second axis from a use position to a stowed position;

a lock configured to selectively lock the second hinge such that the beverage container holding portion cannot pivot from the use position to the stowed position; and a button disposed on the beverage container holding portion configured to unlock the lock to allow the beverage container holding portion to transition from the use position to the stowed position.

2. The adjustable cup holder of claim 1, further comprising a connector coupled to the body configured to be removably coupled to a structure.

3. The adjustable cup holder of claim 1, wherein the beverage container holding portion comprises an adjustable diameter ratchet strap coupled to the body, wherein the base is constructed and arranged to support the weight of a beverage container, and the adjustable diameter ratchet strap is configured to accommodate the diameter of a beverage container to limit the beverage container from tipping relative to the body.

4. The adjustable cup holder of claim 2, wherein the beverage container holding portion comprises an adjustable diameter ratchet strap coupled to the body, wherein the base is constructed and arranged to support the weight of a beverage container, and the adjustable diameter ratchet strap is configured to accommodate the diameter of a beverage container to limit the beverage container from tipping relative to the body.

5. The adjustable cup holder of claim 4, further comprising a stop configured to stop rotation of one or both of the base and the adjustable diameter ratchet strap beyond a desired position.

6. The adjustable cup holder of claim 1, wherein each arm comprises a bend along the length of the arm such that neither arm interferes with the insertion of a beverage container.

7. The adjustable cup holder of claim 2, wherein the connector comprises first and second opposing hemispheres.

8. The adjustable cup holder of claim 7, wherein the connector further comprises a wire strap that connects the opposing hemispheres, wherein the wire strap is configured to lock the connector to the structure.

* * * * *